US005749780A

United States Patent [19]

Harder et al.

[11] Patent Number: 5,749,780

[45] Date of Patent: May 12, 1998

[54] ROOF VENT

[75] Inventors: Sven Harder, Vallensbaek; Jan Borst, Elsinore, both of Denmark

[73] Assignee: Icopa A/S, Herlev, Denmark

[21] Appl. No.: 711,416

[22] Filed: Sep. 5, 1996

[51] Int. Cl.[6] ..... F24F 7/02

[52] U.S. Cl. ..... 454/359; 52/199; 236/49.5; 454/361; 454/368

[58] Field of Search ..... 454/358, 359, 454/361, 362, 363, 368; 236/49.5; 52/198, 194

[56] References Cited

U.S. PATENT DOCUMENTS

| | | | |
|---|---|---|---|
| 1,063,068 | 5/1913 | Rose | 454/362 |
| 3,984,947 | 10/1976 | Patry | 52/199 X |
| 4,538,508 | 9/1985 | Ballard | 454/359 X |
| 4,557,081 | 12/1985 | Kelly | 52/94 |
| 4,593,504 | 6/1986 | Bonnici et al. | 52/199 |

FOREIGN PATENT DOCUMENTS

| | | | |
|---|---|---|---|
| 3439729 | 4/1986 | Germany . | |
| 1 289 758 | 9/1972 | United Kingdom | 52/199 |
| 95/18899 | 7/1995 | WIPO . | |

*Primary Examiner*—Harold Joyce
*Attorney, Agent, or Firm*—Thomas R. Vigil

[57] ABSTRACT

A roof vent (8) comprises a conduit having an open entry end adapted for being arranged in sealing communication with an aperture in a roof surface, and an exit end spaced from said entry end, shield means (31) adapted for preventing entry of rain into said conduit, a valve assembly for controlling flow of air or gas, said valve assembly comprising a valve member (13, 22) adapted for opening to passage of air or gas when the pressure at the entry end exceeds the pressure at the exit end and adapted for closing on other conditions to prevent back-flow of air or gas, and thermostat means (27) adapted for opening said valve member to bidirectional passage of air or gas when the temperature at said thermostat means exceeds a predetermined level.

10 Claims, 7 Drawing Sheets

ROOF VENT

Figure 1:
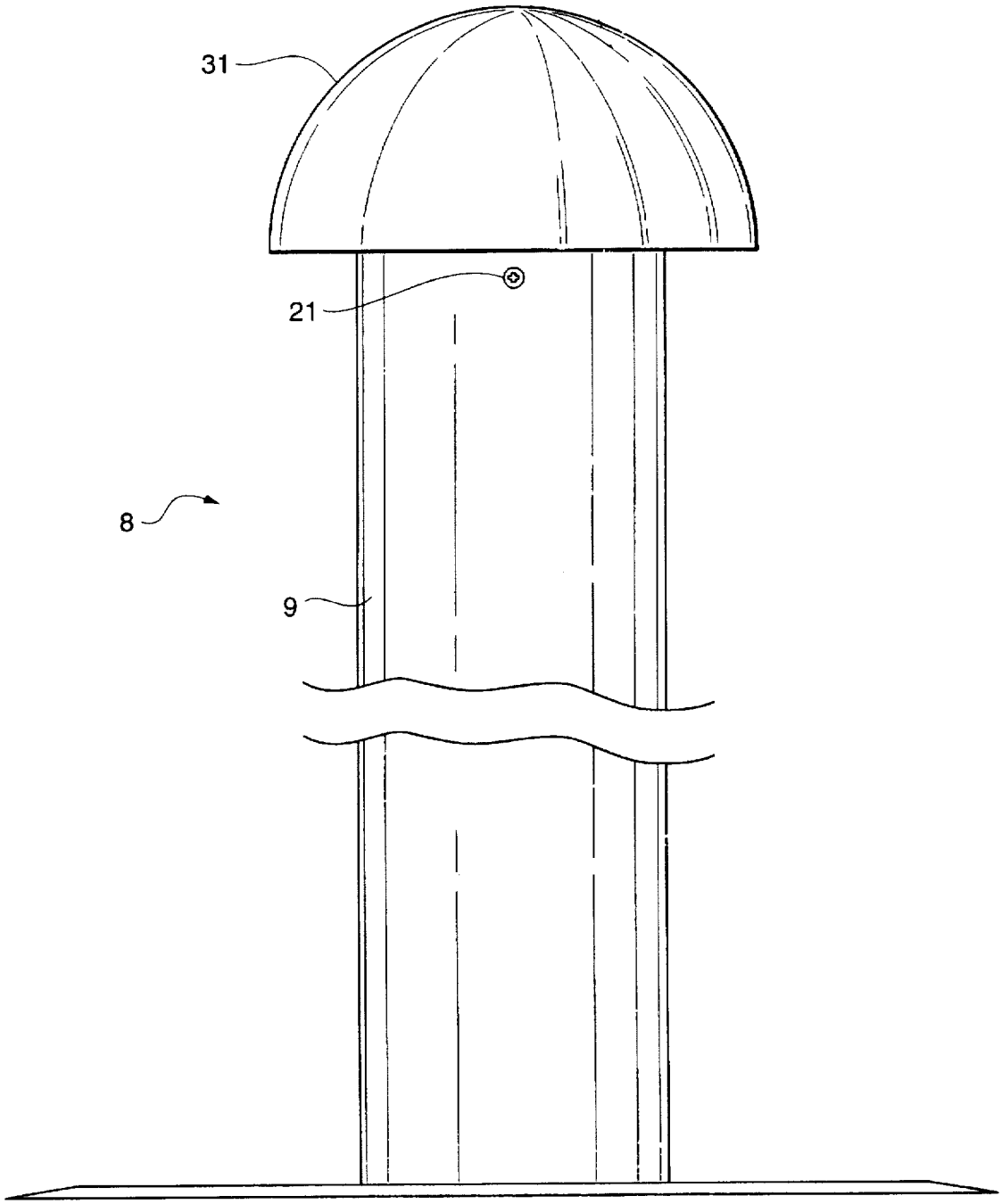

The present invention relates generally to roof structures including vents which permit the escape of air or gas into the open atmosphere and deals more particularly with vents having flow control valves which allow escape of air in order to provide a certain pressure relief of the volume below the roof and allow a controlled ventilation which may extract moisture entrapped beneath an impervious covering of the roof.

In the construction of flat or low pitch roof decks on buildings the roof, generally incorporating a supporting structure together with a layer of insulation, must be topped by a weather proof and water tight roof membrane. The membrane must be capable of tolerating degrading influences of the environment and of withstanding accidental flooding of the roof caused by blocked outlets or the like. Available sheetings or membranes capable of fulfilling these objects, however, are practically impervious to air or gas.

In the construction of buildings and roof decks it is common practice to use materials in which water is a necessary constituent and from which water is discharged over time. This is the case with concrete and also with wooden decks. As it is impossible to dry out these materials completely before or during the construction operation and as moisture trapped in the roof negatively affects the insulation properties and may be detrimental to the structure precautions must be taken for ensuring continuous drying out of the roof.

During normal use of a building air will under conditions where the temperature interiorly exceeds the temperature exteriorly of the building tend to move upwards, carrying with it moisture. When the air meets the roof deck and passes through the insulation it will under such circumstances be cooled, the cooling causing an increase in relative humidity, and quite likely, a condensation of water which is left inside the insulation as the air escapes the roof.

Still another factor to bring moisture into the roof deck may be water from the outside entering through imperfections in the roof membrane.

For reasons of the above mentioned circumstances it is a general practice to design the roof with an air barrier on the interior side of the insulation and with vent openings in the roof membrane. In case of roof membranes on flat or low pitch roof decks roof vents are fitted on top of the roof, a roof vent basically comprising an open tube to be mounted in registry with an aperture in the roof membrane, the tube extending upward above the expected flood level being open to permit venting to the exterior, the opening being fitted with a cap to prevent entry of rain and the like.

Depending on the weather conditions roof constructions are subject to wind uplifts, i.e. under certain wind conditions wind vortexes may form, creating vacuum zones on the outside of the roof membrane perhaps combined with overpressure due to air infiltration below the roof membrane. Simulations have proven a vacuum to as much as 4% of an atmosphere to be possible and roof blow-outs where the roof membrane is separated destructively from its support structure have in fact been reported.

U.S. Pat. No. 4,557,081 contains the suggestion for a hermetically sealed roofing structure with roof vents including check valves. The check valves are oriented to permit any vacuum above the roof membrane to evacuate also the roofing structure below the roof membrane while the valves in case of an overpressure above the roof membrane will close to prevent air infiltration from the outside into the roof structure. This publication discloses a flexible circular flapper valve of an elastomeric sheet fixed at its center and resting, under normal conditions, in a self-sealing manner on an inner rim portion. An alternative embodiment features a duck bill valve.

U.S. Pat. No. 4,593,504 discloses a roof vent also comprising an open tube with a flapper valve at the bottom. This disclosure adresses the problem of condensation of moisture inside the tube, which moisture is drawn by gravity down the side wall of the tube to accumulate on the flapper valve where it may gain entry into the roof when the valve opens or it might freeze in case of cold weather thereby resulting in seizure of the flapper valve. The suggested solution comprises a recess below the flapper valve member to divert moisture away from the flapper valve member and an insulative layer on the side wall of the tube.

U.S. Pat. No. 3,984,947 discloses a one-way vent comprising an open tube with a diaphragm valve on the top of the tube inside a cap. The diaphragm comprises elastomer and air passes the valve through upward openings in the diaphragm.

British patent 1 289 758 discloses a roof vent comprising an open tube with a check valve arranged in the lower portion, the check valve comprising a flexible valve disc restrained to move freely inside the tube between a valve seat and and a screen arranged there above.

German published application 34 39 729 discloses a roof vent comprising an open tube with a ball valve in the lower portion.

International patent application publication WO 95/18899 discloses a roof vent comprising an open tube with a check valve in the upper portion, the check valve comprising a rubber plate. This publication contains a suggestion that the valve should open only when the suction on the roof covering reaches a certain value in order that the movement of room air into the roof structure is reduced. The publication also contains a suggestion of a valve wherein the weight of the valve body determines the pressure difference at which the valve opens and closes, though with no more specific suggestions as to how this could be implemented.

Applicant has found that flapper valves according to the prior art are generally subject to ageing factors and disturbing influences which may cause erratic functioning and which is likely to cause a drifting of the operational characteristics.

The pressure differential necessary to open the valve will basically depend on the weight of the flapper disc and its resilience. Commercially available elastomers, however, exhibit hysteresis and are subject to substantial alteration due to ageing, drastically degrading the resilience. Over time the resilient disc will therefore, in case it is rested on a peripheral valve seat and possibly a central support, tend to assume a cup-like appearance with an upward central cone. With this shape the disc will be likely to accumulate water and dirt. The elastomer may also tend to stick in the valve seat.

Furthermore, flow of wind across the upper surface of the valve disc may tend to lift the valve disc edge facing the wind, possibly causing inflow of air. Influences by cross flow of wind may be reduced by recessing the valve disc down into a lower portion of the tube; however, this aggravates the danger of collecting dust, water, and ice on top of the valve flap. Recessing the valve disc into a lower portion of the tube also reduces the valve through flow sectional area. The result of these factors is that flapper valves generally cannot be trusted to operate to any predictable pressure differential and certainly not to ensure any stable value of the opening pressure taken over time.

The invention provides a roof vent according to claim 1.

Applicant has discovered that, whereas the roof membrane being generally a light structure is generally not expected to tolerate any significant uplift pressure differential, it is still possible to establish a modest level of uplift pressure differential that can be tolerated by the roof membrane with no adverse effects, and applicant has discovered that a significant advantage can in fact be gained by maintaining such a level of pressure differential rather than seeking to obtain a complete pressure equalization.

An uplift pressure differential across the roof membrane may also be referred to as a level of overpressure in the roof structure relative to the pressure above the roof membrane. Applicant has found that it is highly advantageous to maintain such an overpressure as it will hold back or control thermally induced passage of air from the interior of the building through the roof structure to the ambient surroundings above the roof. Some advantages gained by holding back the thermally induced flow of air from the inside of the building are reduced draught inside the building, reduced transport of moisture into the roof structure, and improved thermal insulation.

The hold-back effect may be gained by a modest pressure differential. As an example, it may be computed that the level of overpressure inside a building just below the roof induced due to a higher temperature inside the building than outside may be in the order of $10^{-5}$ atm (in fact $10^{-5}$ atm at height 3 mtrs, temperature differential 10° C). Applicant has found a pressure differential of 0.002 atm to be safely acceptable with roof membranes according to the state of the art. The overpressure tolerable by the roof membrane thus exceeds any thermally induced overpressure expected during normal use of a building by a substantial margin.

Should wind conditions cause a pronounced vacuum above the roof, the valve according to the invention will open to allow a pressure relief so as to reduce the uplift on the roof membrane. The relief will be partial since the valve will throttle the flow to maintain the predetermined pressure differential. Thus the valve will allow safety of the structure to take precedence over the interest of heat insulation etc. Still; the valve will, even in such circumstances, provide some control of the flow by maintaining the predetermined pressure differential.

The invention further provides a roof vent.

This provides a roof vent that will, in conditions where the ambient environment is colder than the building interior, permit only as much flow of air or gas as necessary in order to reduce uplift due to wind on the roof membrane to a level tolerated by the structure, thus controlling inflow of air from the building interior as much as possible whereas the roof vent will, in conditions where the temperature in the surroundings exceeds the temperature inside the building, open to permit unrestricted passage of air or gas.

Applicant has discovered that in conditions where the environment is warmer than the building interior unhindered flow of air is highly desirable as the air will move upwards, sucking air from the building interior through any openings in the air barrier and in the roof deck into the roof insulation and from there through the roof vent into the open air above the roof. When this takes place in hot conditions the air will, when passing through the roof insulation, be heated to reduce relative humidity and to produce a pronounced drying effect on the insulating material and on any parts of the roof structure. The moisture absorbed by the heated air will be carried away from the roof as the air leaves the roof by way of the open roof vents. As soon as conditions change and the roof cools down the thermostat means will cause the valve to revert to its check valve function, generally preventing any backflow or infiltration of humid air.

Figure 3:
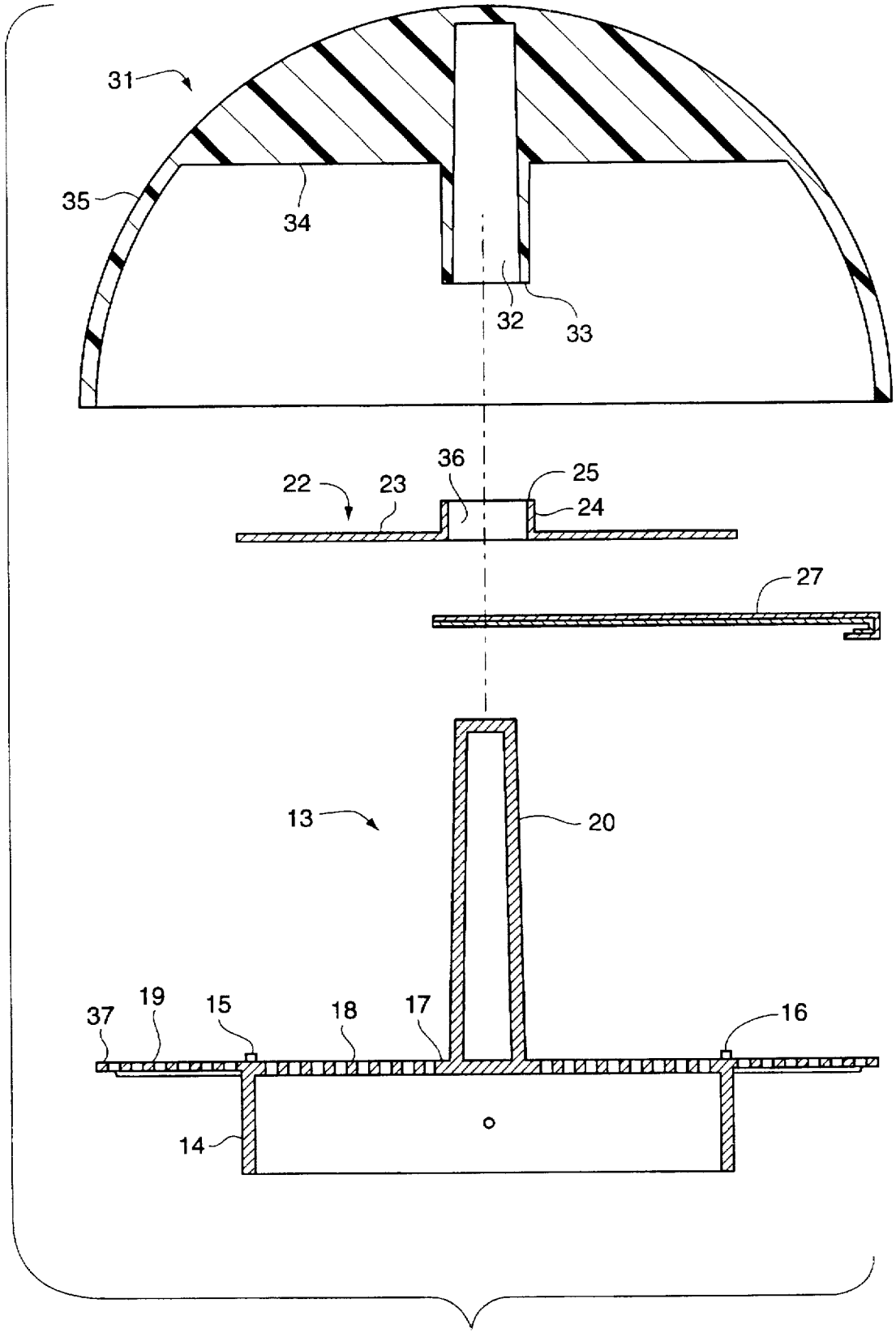
Figure 4:
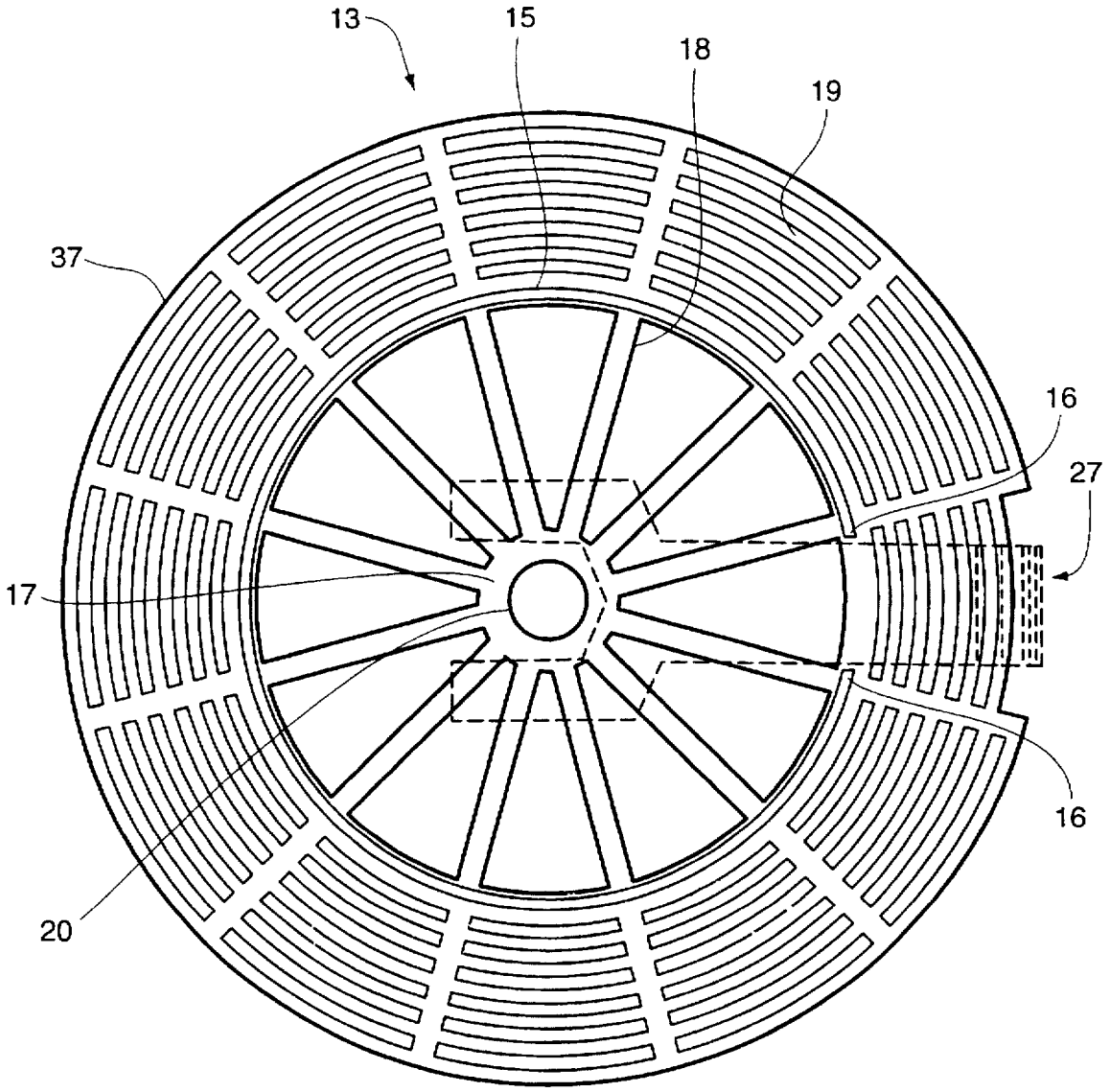
Figure 5:
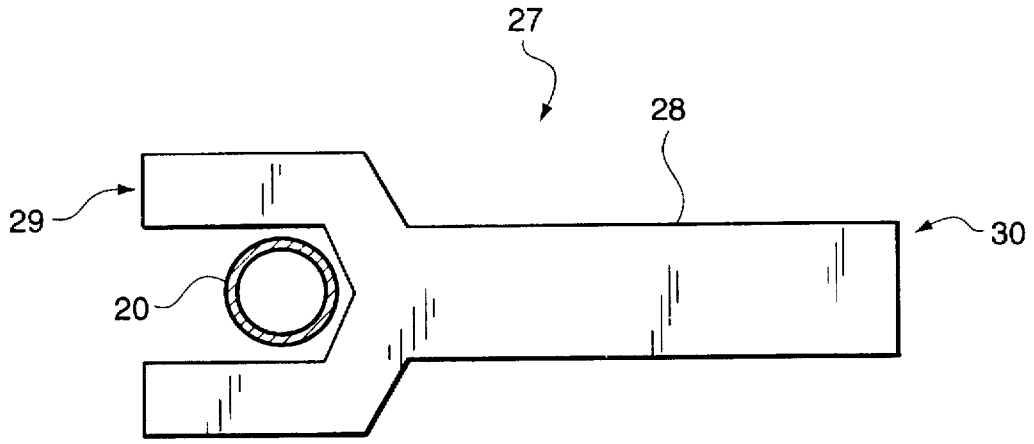
Figure 6:
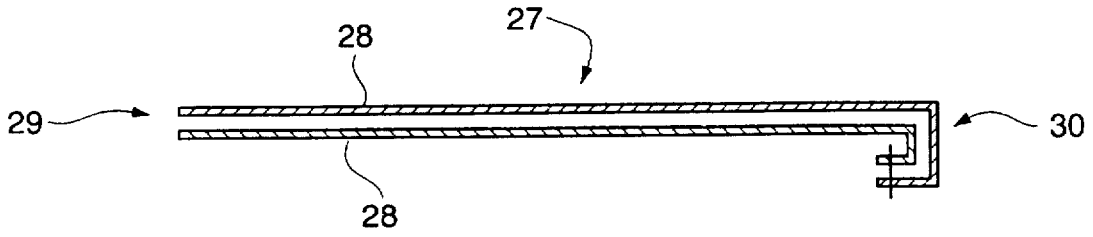
Figure 7:
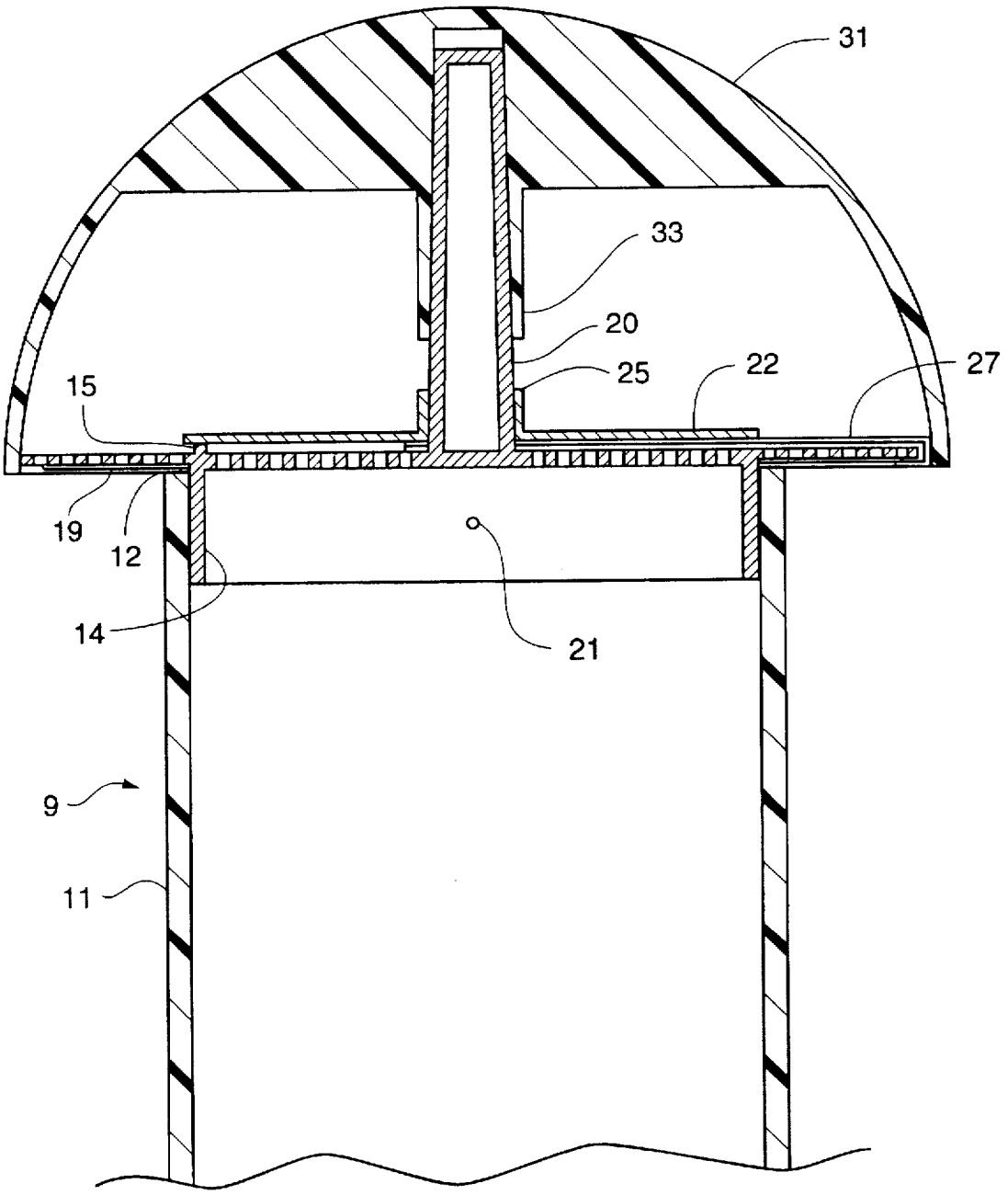
Figure 8:
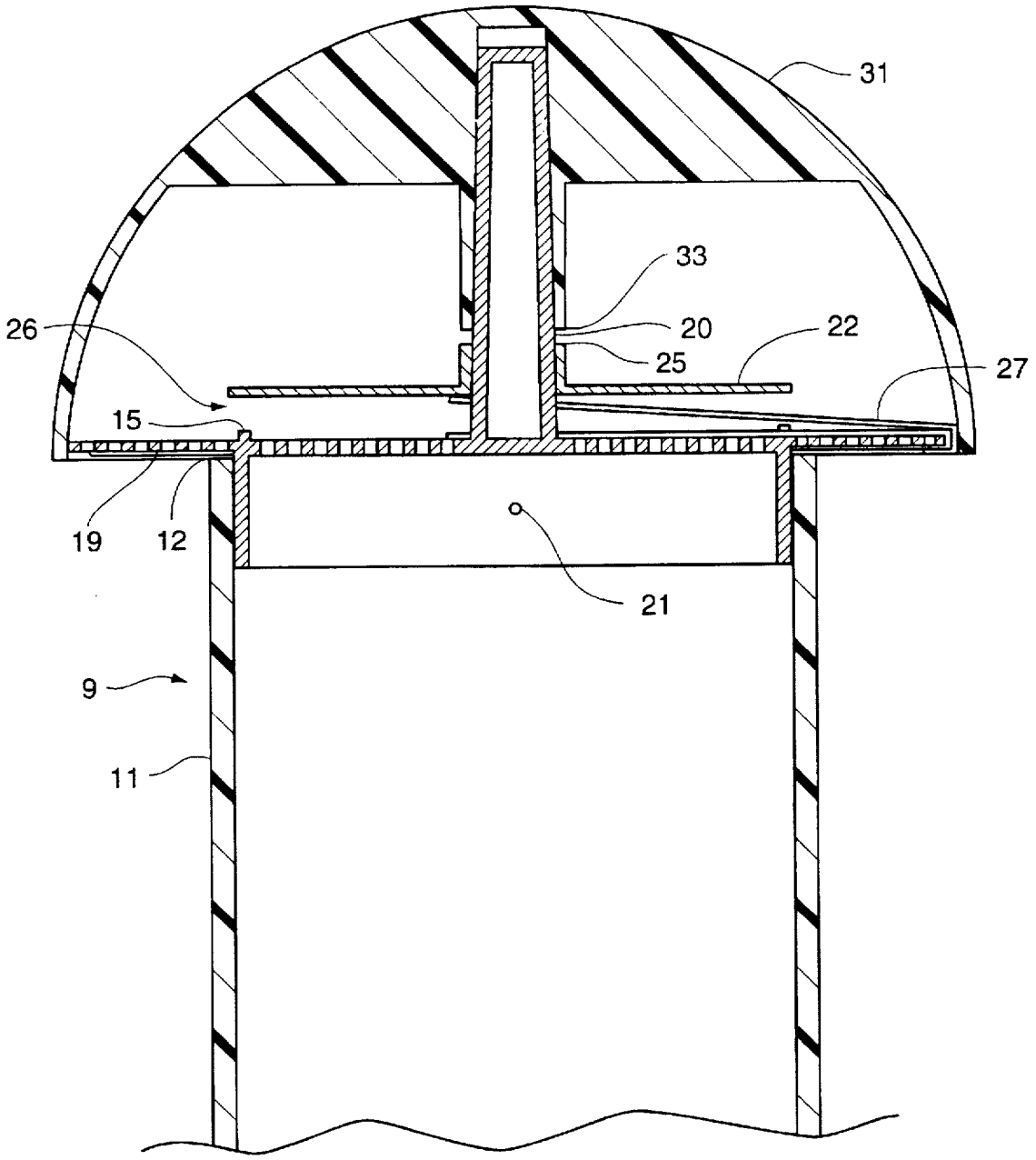

Additional objects and advantages of the present invention will become more readily apparent from the reading of the following detailed description together with the accompanying drawings which set forth preferred embodiments. In the drawings FIG. 1 is a side elevational view of a roof vent according to the invention, FIG. 2 is a vertical section through a roof vent as mounted on top of a roof, the figure also showing a section through a portion of the roof, FIG. 3 shows a section through parts of the roof vent in exploded view, FIG. 4 is a planar view of the valve body which is part of the roof vent according to the invention, FIG. 5 is a planar view of the valve actuator, FIG. 6 is a vertical section through the valve actuator, FIG. 7 is a vertical section through the upper portion of the roof vent illustrating the valve in closed position, and FIG. 8 is a vertical section similar to FIG. 7 but illustrating a situation where the valve member is lifted off the valve seat by the action of the thermostat means.

All drawings are schematic, not necessarily to scale and illustrate only parts essential to the understanding of the invention, whereas other parts are omitted from the drawings to preserve clarity. Throughout all drawings identical or similar parts are designated by the same references.

Referring first to FIG. 1 roof vent 8 is illustrated in side elevational view wherein stack 9, rivet 21 and cap 31 are the only parts of the roof vent visible.

Figure 2:
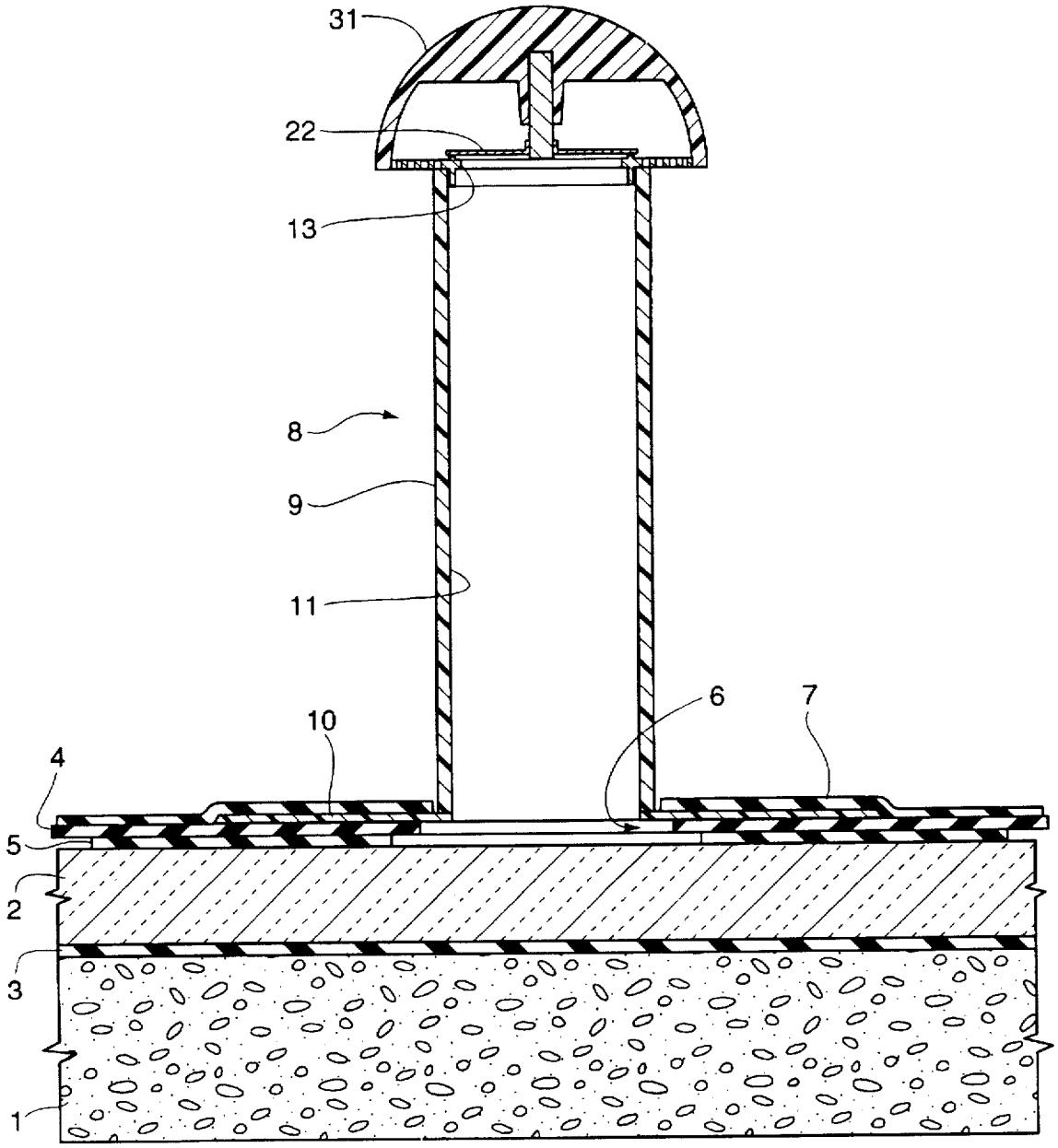

Reference is now made to FIG. 2 for an explanation of more details of the roof vent and also concerning the mounting of the roof vent on the roof. Thus FIG. 2 illustrates the stack 9 generally comprising an open cylindrical tube with circumferential wall 11, open at both ends and provided at the lower end in FIG. 2 with flange 10 integral with the stack 9. These components are in a preferred embodiment manufactured from glass fibre reinforced polyester.

The upper portion of FIG. 2 reveals of the roof vent also valve body 13, valve disc 22, and cap 31.

The lower portion of FIG. 2 illustrates the roof deck 1 comprising e.g. a slab of concrete, thereabove air barrier 3 comprising a thin foil of air impervious material, insulation 2 comprising any insulation material as known in the art, on top of the insulation roof membrane base 5 and roof membrane 4. The roof membrane 4 comprises any material which may be used to build a sealed membrane which is stable under the influences of the environment and practically fully impervious to air and water. The roof membrane base 5 comprises a supporting layer providing support for the roof membrane. The roof membrane base 5 may comprise a layer which serves the purpose of spacing the roof membrane from the insulation and which may comprise grooves or channels permitting cross flow of air as it may be advantageous in case the insulation material is not readily penetrable to air.

In order to install a roof vent, an aperture 6 is cut in the roof membrane and the roof vent 8 is placed with the flange 10 supported on the top of the roof membrane 4 and with the conduit interiorly of the stack 9 in registry with the aperture 6. A flashing membrane 7 is sealed around the flange 10 in order to attach the roof vent structurally and in order to provide a completely water tight connection.

Reference is now made to FIG. 3 showing parts of the top of the roof vent in exploded view. FIG. 3 thus shows cap 31, valve disc 22, valve lifter 27, and valve body 13.

The cap 31 comprises a hemispherical dome 35 provided interiorly with a central socket 32 structurally supported by vanes 34. The socket 32 is cylindrical or slightly tapered. The cap is in the preferred embodiment cast in one piece from polypropylene and preferably coated on the outside in a dark colour.

The valve disc 22 comprises an essentially circular disc portion 23 with a central opening 36 bounded by a sleeve portion 24 extending as shown in the figure from the disc and slightly upwards to terminate at sleeve top edge 25. The top sides of the valve disc 22 and of the top edge 25 are preferably planar or sloping slightly outwards so as to prevent accumulation of water and dust on these parts. In the preferred embodiment the valve disc is cast in one piece from polypropylene.

The lowermost component illustrated in FIG. 3 is valve body 13 which appears in planar view in FIG. 4. The valve body is a component which may be cast in one piece from a plastic material such as polypropylene. The valve body comprises a central boss 20 which is cylindrical or slightly tapered and extends upwards in FIG. 3 from hub portion 17. The hub portion 17 joins radial struts 18 which extend past rim 14 to valve body periphery 37. Rim 14 is a short circular tube-like portion adapted to fit snugly inside the upper end of the stack 9 (re. FIG. 2). Adjacent rim 14, the edge of a small ledge extending to the opposite side of rim 14 forms a circular valve seat 15. In the annular region between the rim 14 and the periphery 37, the struts are interconnected by annularly extending spaced ribs to form a grid 19.

The grid is matched as may be understood referring in particular to FIG. 8 to fit inside the dome 35 near the dome lower edge.

Reference is now made to FIGS. 5 and 6 for a description of the valve actuator, also referred to as the valve lifter 27. The valve lifter essentially comprises two blades 28 stamped out along almost identical contours (the one is slightly longer than the other one) each blade being provided with a bifurcated end 29. Each of the blades is stamped from a bimetal plate, the pair of plates being overlaid in a back-to-back orientation and folded backwards at the ends 30 opposite bifurcated ends and permanently joined at the folded ends e.g. by means of a rivet.

The preferred thickness of each blade 28 is 1.2 mm. A grade R80-AS material according to class TM1, ref. ASTM B388 which is a standard general purpose bimetal alloy has been found to perform satisfactory. A bimetal alloy of this kind has the property that it will bend on increasing temperature, the variation of the bending angle corresponding almost linearly with the variation of the temperature. In the valve lifter according to the invention the blades are oriented in order that the respective bifurcated ends will spread on heating.

According to the invention the valve lifter is placed on top of the valve body 13 in the position as illustrated in phantom in FIG. 4, the ledge providing the valve seat 15 being recessed at 16 to accommodate the valve lifter in order that the valve may come to rest in the valve seat. The bifurcated ends are adapted to engage boss 20 in a free sliding fashion.

During assembly of the roof vent 8 valve disc 22 is threaded on to the boss 20 which serves to guide the valve disc by the sleeve portion 24 in a freely sliding fashion. Subsequently the cap 31 is mounted with the socket 32 in press fitting engagement with the top of the boss 20. The socket and the boss may be held together by press fitting, possibly assisted by adhesives, a snap means or other conventional means. Once the cap has been fitted the lower portion of the dome 35 ensures that the valve lifter 27 cannot escape the engagement with the boss sideways.

In this state the cap socket lower edge 33 interacts with the sleeve top edge 25 to provide a stop limiting upward displacement of the valve disc. The top assembly is then fitted on the stack 9, the rim 14 fitting inside the open end of the stack and the struts being supported on the stack wall top edge 12. The top assembly may be secured relative to the stack wall 11 by rivets 21 or other conventional means.

The functioning of the valve will now be described with particular reference to FIGS. 7 and 8.

FIG. 7 shows a situation where the blades 28 of the valve lifter 27 are situated closely together such as would be the case in cold conditions. The valve disc 22 rests with the edge supported on valve seat 15 in sealing engagement. Thus the valve is closed. Any leakages in the closed state are considered to be insignificant in the context of this invention as long as the vent is capable of controlling flow to the extent that the vent may maintain a pressure drop which can hold back air flow due to the difference of temperatures between the building interior and exterior.

FIG. 8 shows the situation where the bifurcated ends 29 of the valve lifter 27 have moved apart to lift the valve disc 22 as would be the case in high temperature conditions. In this case the valve is open permitting flow from the roof below the membrane through the conduit provided by the stack through the open spaces between the struts, the gap 26 between the valve disc and the valve seat, the interior of the dome 35 and the apertures in the grid 19 to the surroundings. The flow is substantially unrestricted and may proceed bidirectionally.

In the preferred embodiment the valve lifter is designed to permit the valve to be closed at all temperatures below 15° C. and to start lifting the valve disc when the temperature exceeds that value. With the above mentioned grade of bimetal and with blade thickness 1.2 mm and blade length approx. 90 mm the valve lifter will on e.g. 20° C. temperature difference be able to produce an excursion of 5 mm. i.e. the gap 26 will be opened 5 mm at a temperature of 35° C. The lift may increase on higher temperatures, the excursion being limited when the sleeve top edge 25 engages the socket lower edge 33 of the cap 31. Variations of the temperature characteristics, e.g. due to component tolerances, may influence the opening threshold temperature, which is considered to be non-critical. According to a preferred embodiment, the dome is darkly colored on the outside in order to absorb heat exchange with the surroundings by radiation. This enhances and accelerates the response of the thermostat to changing temperatures.

In circumstances where the valve disc is not lifted by the valve lifter it may be lifted by a pressure differential across the valve disc. Given that the valve seat is circular with a diameter of approx. 115 mm the area effected by the differential pressure is 0.01 $m^2$. Provided the valve disc is ballasted to a weight of 20 g it will in this case lift for a pressure diffential of 0.002 atm. As the weight as well as the area are stable parameters, which are easily selected at the design stage, easily met during manufacturing, and easily verifiable the valve can be trusted to respond very accurately and reliably to pressure differentials.

The closing force being provided by the force of gravity will necessarily be independent of the air flow rate thus the valve will essentially, regardless of the flow, throttle the gap 26 so as to maintain exactly a pressure differential just supporting its own weight.

In circumstances where the valve disc is partially lifted by the action of the valve lifter, it is free to respond to a pressure differential exceeding the predetermined level, i.e. regardless of the action of the valve lifter the pressure differential across the valve will never exceed the preset value.

Obviously, the valve may easily be tuned to other pressures by varying the ballasting of the valve disc. Naturally, it is preferable to take care of forming all upper surfaces of the valve disc so as to prevent accumulation of water or dust on top of the disc in order to prevent disturbing influences. Although the thermostat means in the preferred embodiment is implemented in the form of bimetal alloy blades, it will be obvious to those skilled in the art to substitute these with thermostats of other forms or based on other principles capable of achieving a similar function. Accordingly such modifications are considered to lie within the scope of the invention.

Although specific preferred embodiments have been described it is obvious that those skilled in the art may make various modifications without departing from the spirit and scope of the invention. Accordingly it is to be understood that the above explanation is offered solely to facilitate the understanding of the invention and not to limit the scope which is defined solely by the appended claims.

What is claimed is:

1. A roof vent comprising a conduit having an open entry end adapted for being arranged in sealing communication with an aperture in a roof surface, and an exit end spaced from said entry end, said roof vent further comprising a shield means adapted for preventing entry of rain into said conduit, a valve assembly for controlling flow of air or gas, said valve assembly comprising a valve member adapted for opening to passage of air or gas when the pressure at the entry end exceeds the pressure at the exit end and adapted for closing on other conditions to prevent backflow of air or gas, and thermostat means adapted for opening said valve member to bidirectional passage of air or gas when the temperature at said thermostat means exceeds a predetermined level.

2. The roof vent according to claim 1, characterized by the valve assembly comprising a valve member biased towards sealing engagement with a valve seat by the action of the force of gravity.

3. The roof vent according to claim 2, characterized by the valve member being ballasted to lift at a pressure differential of approximately 0.2% of the atmospheric pressure.

4. The roof vent according to claim 1, characterized by comprising a generally cylindrical tube with a flange at one end for mounting said roof vent on said roof, with the valve assembly arranged at the opposite end and with a cover arranged to shield said valve assembly.

5. The roof vent according to claim 1, characterized by all upward faces of said valve member being formed so as to essentially prevent accumulation of water.

6. The roof vent according to claim 1, characterized by the valve assembly comprising a valve body with a generally circular valve seat and a boss extending axially relative to said valve seat and a valve member with a substantially circular disc with a central opening adapted for sliding engagement with said boss.

7. The roof vent according to claim 6, characterized by the valve body and the valve member being provided with a respective stop means interacting to limit the travel of the valve member.

8. The roof vent according to claim 1, characterized by the thermostat means comprising a bimetal blade means.

9. The roof vent according to claim 8, characterized by the thermostat means comprising two overlaying oppositely oriented bimetal blades, interconnected at one end so as to move apart at the opposite respective ends in response to increasing temperature, said moving ends being arranged to lift the valve member.

10. The roof vent according to claim 1, characterized by said shield means comprising a cap which is darkly coloured on the outside in order to enhance emission or absorption of heat radiation.

* * * * *